US011959233B2

(12) United States Patent
Holfelder

(10) Patent No.: US 11,959,233 B2
(45) Date of Patent: Apr. 16, 2024

(54) CONTACT-FREE MATERIAL TRANSFER BETWEEN A TRUCK AND A DRIVING ROAD CONSTRUCTION VEHICLE

(71) Applicant: JOSEPH VOEGELE AG, Ludwigshafen/Rhein (DE)

(72) Inventor: Jens Holfelder, Limburghof (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 156 days.

(21) Appl. No.: 17/184,015

(22) Filed: Feb. 24, 2021

(65) Prior Publication Data

US 2021/0262177 A1 Aug. 26, 2021

(30) Foreign Application Priority Data

Feb. 26, 2020 (EP) ..... 20159469

(51) Int. Cl.
*E01C 19/00* (2006.01)

(52) U.S. Cl.
CPC ..... *E01C 19/006* (2013.01); *E01C 2301/04* (2013.01)

(58) Field of Classification Search
CPC ..... E01C 19/006; E01C 2301/04
USPC ..... 404/84.05, 118, 72, 75
See application file for complete search history.

(56) References Cited

U.S. PATENT DOCUMENTS 5,921,708 A 7/1999 Grundl et al.
8,931,974 B2 1/2015 Herzberg
9,481,964 B1 * 11/2016 Marsolek ..... G08G 1/20
10,533,293 B2 1/2020 Hoffmann et al.
10,685,564 B1 * 6/2020 Vrchota ..... G05D 1/0231
10,895,046 B2 1/2021 Buschmann et al.
11,091,886 B2 8/2021 Fickeisen et al.
2010/0215433 A1 * 8/2010 Fritz ..... E01C 19/006 404/84.5
2010/0296867 A1 11/2010 Buschmann et al.
2016/0170415 A1 6/2016 Zahr
(Continued)

FOREIGN PATENT DOCUMENTS

CN 101892623 A 11/2010
CN 102409592 A 4/2012
(Continued)

OTHER PUBLICATIONS

Indian Examination Report dated Jan. 14, 2022, Application No. 202114006960, 5 Pages.
(Continued)

*Primary Examiner* — Raymond W Addie
(74) *Attorney, Agent, or Firm* — BROOKS KUSHMAN P.C.

(57) ABSTRACT

In the method for transferring material between a truck and a driving road construction vehicle, a distance between the driving road construction vehicle and a truck driving in front of the road construction vehicle without contact to the road construction vehicle truck is kept constant by a distance control system. While the distance between the driving road construction vehicle and the truck is kept constant, material is being dumped from a loading cavity of the truck into a material hopper of the road construction vehicle. The road construction vehicle is a road finishing machine or a feeder for a road finishing machine.

19 Claims, 3 Drawing Sheets

(56) References Cited

U.S. PATENT DOCUMENTS

| | | | | |
|---|---|---|---|---|
| 2017/0060126 | A1 | 3/2017 | Marsolek et al. | |
| 2019/0248265 | A1 | 8/2019 | Godwin, Jr. | |
| 2019/0377363 | A1 | 12/2019 | Shelton et al. | |
| 2020/0292348 | A1* | 9/2020 | Chambers | G01C 21/367 |
| 2020/0324688 | A1* | 10/2020 | Anderson | H05B 45/10 |

FOREIGN PATENT DOCUMENTS

| | | | |
|---|---|---|---|
| CN | 105735093 | A | 7/2016 |
| CN | 109177972 | A | 1/2019 |
| DE | 297 15 467 | U1 | 10/1997 |
| DE | 20 2012 003689 | U1 | 5/2012 |
| DE | 10 2015 009699 | A1 | 2/2016 |
| EP | 0 667 415 | A1 | 8/1995 |
| EP | 0 834 620 | A1 | 4/1998 |
| JP | H3-199508 | A | 8/1991 |
| JP | H4-122706 | U | 11/1992 |
| JP | H10-207544 | A | 8/1998 |
| JP | 2002-173908 | A | 6/2002 |
| JP | 2018-190228 | A | 11/2018 |
| JP | 2019-203374 | A | 11/2019 |
| JP | 2020-23869 | A | 2/2020 |
| JP | 2020-80175 | A | 5/2020 |

OTHER PUBLICATIONS

Japanese Office Action (with English Machine Translation) dated Feb. 8, 2022, Application No. 2021-030002, 6 Pages.

Chinese Search Report (with English Translation) dated Jun. 14, 2022, Application No. 202110224089.X, 5 Pages.

Chinese Office Action (with English Translation) dated Jun. 24, 2022, Application No. 202110224089.X, 14 Pages.

European Search Report dated Sep. 16, 2020 (with English Machine Translation), Application No. 20159469.4-1002, Applicant Joseph Voegele AG, 12 Pages.

Chinese Office Action dated Sep. 10, 2021 (with English Machine Translation), Application No. 202120421100.7, 4 Pages.

Brazilian Office Action for Patent Application No. 102021003418-1, dated Jan. 12, 2024, 8 Pages (including English machine translation).

* cited by examiner

CONTACT-FREE MATERIAL TRANSFER BETWEEN A TRUCK AND A DRIVING ROAD CONSTRUCTION VEHICLE

CROSS-REFERENCE TO RELATED APPLICATIONS

This application claims foreign priority benefits under 35 U.S.C. § 119(*a*)-(*d*) to European patent application number EP 20159469.4, filed Feb. 26, 2020, which is incorporated by reference in its entirety.

TECHNICAL FIELD

The disclosure relates to transferring material between a truck and a road finishing machine driving behind the truck or a feeder for a road finishing machine driving behind the truck.

BACKGROUND

To achieve uniform and good paving results, a road finishing machine should not be slopped during the paving of a road surface. The road surface should be preferably paved in one operation. Since the material hopper of the road finishing machine, however, only has a limited capacity for receiving paving material, it is normally necessary to provide the road finishing machine with additional paving material during the paving operation. It is common practice to supply paving material from a mixing plant by means of trucks and dump it from the truck into the material hopper of the road finishing machine during the paving operation. Presently employed road finishing machines comprise, in their front region with respect to the paving direction, push rollers which are engaged with the back tires of the truck. The truck approaches the road finishing machine backwards and has itself pushed in front of the road finishing machine by the road finishing machine via contact of the push rollers with the back tires of the truck. While the truck is being pushed in front of the road finishing machine, the truck dumps paving material into the material hopper provided at the front of the road finishing machine, seen in the direction of travel, by lilting its loading cavity. During the docking between the truck and the road finishing machine, and during the dumping of the material into the material hopper, good communication between the finishing machine's driver and the truck's driver is essential. The truck has to stop the backward drive at the right point in time and release the brakes or brake with an adapted brake force so that the truck can be pushed by the road finishing machine. Docking should be preferably done without jerks in order not to impair the paving result. An additional power demand of the road finishing machine to push the truck in front of it arises. For setting a suitable tilting angle of the loading cavity of the truck, the truck's driver depends on instructions of the finishing machine's driver or a signaller since the truck's driver cannot view, or cannot properly view, the situation at the material hopper.

From EP 0 677 415 A1, a road finishing machine with an apparatus for monitoring and displaying operating parameters of the road finishing machine relevant for a feeding with paving material is known. The apparatus comprises a distance sensor that is facing forward in the direction of travel and is able to determine the distance to the rear end of the truck. The apparatus furthermore comprises a sensor by which the degree of filling or the filling level in the material hopper can be determined. In the operating region of the drive fs cabin of the road finishing machine, an electronic display panel is arranged to be easily visible by the driver of the truck. A data processing system is connected to the display panel and receives the signals from the sensors and converts them into commands that appear on the display panel in the form of pictographs or analogue indications. With the information on the display panel, the docking operation of the truck against the push rollers of the road finishing machine and the material transfer between the truck and the road finishing machine may be facilitated.

DE 10 2015 009 699 A1, a road finishing machine is known which preferably comprises at least two sensors so that an approaching truck may be detected from various directions, and thus a three-dimensional image of the docking operation of the truck may be generated. Due to the increased number of sensors, the docking operation of the truck to the storage container of the road finishing machine is to be controlled very precisely. During the filling operation of the storage container with road construction material, the truck is to be detected by at least two sensors to determine when the truck is drifting away from its filling position. Moreover, on the basis of determined positional data of the truck, steering instructions for the truck are to be generated.

US 2019/0248265 A1 describes a remote control system for a loading cavity of a truck which moves along with a road finishing machine for filling the material hopper of the road finishing machine in contact with front rollers of the road finishing machine. The remote control system permits a driver of the road finishing machine or another person to lift or lower the loading cavity of the truck. The driver of the road finishing machine can directly view the material hopper and the loading cavity of the truck in the process.

It is moreover known from practice not to fill a road finishing machine directly by dumping paving material from a truck into the material hopper of the road finishing machine, but to rather transfer the paving material from the truck onto a feeder driving in front of the road finishing machine. The feeder comprises a material hopper into which the truck dumps the paving material. In the rear with respect to the direction of travel, the feeder comprises a conveying device by which the paving material is then conveyed into the road finishing machine driving behind the feeder. Feeders are known, for example, from DE 297 15 467 UK or from HP 0 834 620 A1.

SUMMARY

It is an object of the disclosure to improve a material transfer between a truck and a driving road construction vehicle with respect to a simple performance and as little impairments of the paving result as possible.

This object is achieved by the method of the disclosure or by the use according to the disclosure.

The disclosure provides a method for transferring material between a truck and a driving road construction vehicle. The road construction vehicle may be a road finishing machine or a feeder for a road finishing machine. By means of a distance control system, a distance between the driving road construction vehicle and a truck driving in front of the road construction vehicle without any contact with the road construction vehicle is kept constant. While the distance between the driving road construction vehicle and the truck is being kept constant, material is dumped from a loading cavity of the truck into a material hopper of the road construction vehicle.

The distance control system may ensure that the distance between the driving road construction vehicle and the truck during the material transfer permits a dumping of material from the loading cavity of the truck into the material hopper, and that moreover a contact between the truck and the road construction vehicle is avoided. A docking between the truck and the road construction vehicle by physical contact of the truck with the road construction vehicle is not necessary. Concussions that would appear during a docking with physical contact between the truck and the road construction vehicle are avoided. Thus, negative influences of the material transfer on the paving result are avoided. The fact that there is no contact between the truck and the road construction vehicle may in particular mean that there is no contact in such a way that the truck is partially or completely pushed by the road construction vehicle. How-ever, there may still be a contact between components of the truck and the road construction vehicle. For example, a dumping flap of the loading cavity of the truck or another part of the loading cavity of the truck may touch the material hopper of the road construction vehicle during the dumping of the material.

Since the truck is not pushed by the road construction vehicle during the material transfer, the required driving power of the road construction vehicle is reduced. It is moreover not necessary to adapt the driving power of the road construction vehicle for the material transfer as this would be necessary for a physical docking of the truck to the road construction vehicle. Compared to a material transfer with physical contact between the truck and the road construction vehicle, the demands on the skills and experience of the truck's driver and the driver of the road construction vehicle are reduced.

As mentioned, the road construction vehicle is a road finishing machine or a feeder for a road finishing machine. The disclosure is particularly advantageously used with a road finishing machine since here the avoidance of a physical docking of the truck to the road finishing machine has a direct positive influence on the paving result. In particular, impressions and irregularities in the installed surface which could arise during a physical docking of the truck to the road finishing machine and require a subsequent remedy of the defects are avoided. Even if the disclosure is used for the material transfer between a truck and a feeder, advantages result with respect to the facilitated practicability of the method for the drivers and the reduced driving power of the feeder.

In order to be easily accessible by a truck driving ahead for the material transfer, the material hopper may be provided at the front of the road construction vehicle with respect to a paving direction.

Preferably, the truck is driven by its own travel drive during the material transfer. If the truck is driving through its own travel drive during the material transfer, it is not necessary to other-wise provide capacities for moving the truck during the material transfer (for example at the road construction vehicle).

The distance control system may comprise a sensor device which determines the distance between the driving road construction vehicle and the truck driving in front of the road construction vehicle. An output of the sensor device may be used as a measured quantity for the distance control.

The sensor device may comprise a distance sensor which is provided at the road construction vehicle. If the distance sensor is provided at the road construction vehicle, it may be sufficient to provide one (or several) distance sensors at the road construction vehicle even if the road construction vehicle is to be supplied with material from a plurality of different trucks.

The sensor device may comprise a distance sensor which is provided at the truck. The distance sensor may optionally be used at the truck for further functions. For example, the distance sensor may be part of a driver assistance system of the truck. If the distance sensor is provided at the truck, the amount of data to be transmitted from the road construction vehicle to the truck for distance control may be reduced.

The distance control system may generate control instructions for a speed of the truck. The control instructions for the speed of the truck may be generated, for example, in such a way that a distance between the driving road construction vehicle and the truck is controlled to a predetermined value or to a predetermined range. The distance control may admit some variation of the distance between the driving road construction vehicle and the truck from a set-point of the variation. The admissible variation may be determined such that, within the limits determined by the variation, a secure filling of the material hopper of the road construction vehicle by dumping of material from the loading cavity of the truck is still possible.

The distance control system may comprise a control unit which automatically controls a travel drive and or a brake of the mick to keep the distance between the driving road construction vehicle and the truck constant. The control unit may control the travel drive and or the brake of the truck in particular based on the output of a distance sensor which measures the distance between the driving road construction vehicle and the truck driving in front of the road construction vehicle. Automatic control of the travel drive and or the brake of the truck during material transfer ensures that the distance between the road construction vehicle and the truck is reliably kept constant and the material transfer may be performed in a reliable and secure manner. The automatic control of the travel drive and or the brake of the truck permits the truck's driver to concentrate on other tasks, for example on steering the truck.

The distance control system may comprise components provided on the road construction vehicle and components provided on the truck. It would also be conceivable that the distance control system is completely provided on the truck. The control unit of the distance control system may be provided on the road finishing machine or on the truck. It would also be conceivable that the control unit comprises several components of which one or several ones are provided on the road finishing machine and one or several ones are provided on the truck.

Information for the distance control may be wirelessly transmitted from the road construction vehicle to the truck. With a suitable communications protocol, wireless transmission may be established fast and without any major installation efforts on site. The wireless transmission of information may be accomplished, for example, via mobile communications, via WIFI, via radio communications, via ZigBee, via Bluetooth or via other suitable ways of transmission. Wireless transmission may be effected directly between the road construction vehicle and the truck or indirectly via a server or any other detour. In the establishment of a wireless trans-mission between the road construction vehicle and the truck, identification information may be exchanged.

Before the start of the material transfer, the truck may log in at the road construction vehicle. This may be done, for example, by wireless communication between the road construction vehicle and the truck. Based on an identification of the truck, parameters of the distance control, in particular a setpoint of the distance to be controlled, may be selected from a database.

The steering of the truck may be performed by a driver of the truck. Since there is no physical contact between the truck and the road construction vehicle, minor irregularities in the steering of the truck do not have any influence on the paving result. As an alternative, it would also be conceivable to automate the steering of the truck.

According to an embodiment, the distance control system controls the distance between the driving road construction vehicle and the truck driving in front of the road construction vehicle to a value (or a range) which is selected from a lookup table based on a type of the truck and/or a type of the road construction vehicle. The lookup table may ensure that the distance between the road construction vehicle and the truck is suitable for a smooth material transfer between the truck and the road construction vehicle. The entries in the lookup table may have been, for example, established in view of the special geometries of different types of trucks and different types of road construction vehicles.

A tilting function of the loading cavity of the truck may be remote-controlled, in particular from the road construction vehicle. The actuation of the tilting function may comprise the lilting of the loading cavity for dumping the material into the material hopper of the road construction vehicle. A remote control of the tilting function of the loading cavity of the truck from the road construction vehicle facilitates to consider the respective loading condition of the material hopper of the road construction vehicle since the loading condition of the material hopper may be particularly easily viewed or monitored from the road construction vehicle. It would also be conceivable that, for example, an operator remotely controls the tilting function of the loading cavity of the truck from the floor.

The tilting function of the road construction vehicle may be remote-controlled manually by a driver of the road construction vehicle or by another person. The driver of the road construction vehicle or the other person may cheek the filling level of the material hopper and or the current material transfer situation by visual contact, and remotely control the tilting function of the loading cavity of the truck based thereon. It would also be conceivable that the driver of the road construction vehicle or the other person controls the tilting function of the loading cavity of the truck based on a sensor information, for example based on an output of a filling level sensor which determines a filling level of the material hopper.

At the load construct ion vehicle, a filling level sensor may be provided which determines a filling level of the material hopper. The tilting function of the loading cavity of the road construction vehicle may be automatically remote-controlled based on an output of the filling level sensor. For example, the loading cavity of the truck may be further lilted if a filling level of the material hopper falls below a predetermined value. If a predetermined value for the filling level of the material hopper is exceeded, the loading cavity of the truck may be lowered to avoid an excessive filling of the material hopper.

The disclosure also provides a use of a distance control system. Features and illustrations dc-scribed with respect to the method may be transferred to the use and vice-versa.

According to an aspect of the disclosure, a distance control system for keeping constant a distance between a driving road construction vehicle and a truck driving in front of the road construction vehicle without any contact to the road construction vehicle during a material trans-fer between the truck and the road construction vehicle. The road construction vehicle is a road finishing machine or a feeder for a road finishing machine.

The distance control system may comprise a sensor device which determines the distance between the driving road construction vehicle and the truck driving in front of the road construction vehicle.

BRIEF DESCRIPTION OF THE DRAWINGS

Below, the disclosure will be further illustrated by way of exemplary embodiments with reference to the Figures.

DETAILED DESCRIPTION

Figure 1:
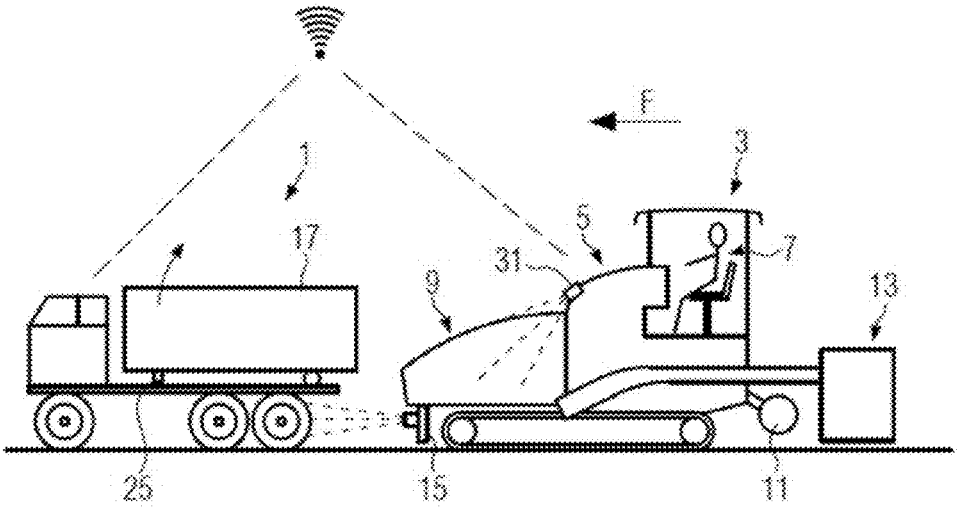
FIG. 1 shows a schematic representation for describing a material transfer between a truck and a road construction vehicle embodied as a road finishing machine according to an embodiment with a distance sensor provided at the road construction vehicle.

The disclosure relates to transferring material between a truck 1 and a driving road construction vehicle. FIG. 1 shows an embodiment in which the road construction vehicle is a road finishing machine 3. The road finishing machine 3 is paving a road surface while it is driving over a foundation along a paving direction F. The road finishing machine 3 comprises a tractor 5 with a control platform 7 arranged thereon for a machine's driver. At the front at the road finishing machine 3, a material hopper 9 is provided for receiving paving material. The paving material is transported from the material hopper 9 via a transport device (not shown) into a rear region of the road finishing machine 3 where it is distributed in a width direction of the road finishing machine 3 by a transverse distributor screw 11. Subsequently, the paving material is compacted by a screed 13 of the road finishing machine 3 towed along behind the tractor 5. In order to install a high-quality and uniform roadway pavement, the road finishing machine 3 should pave sections as large as possible without interruption. Since the material hopper 9, however, only has a limited capacity, it is required 10 fill the material hopper 9 with further paving material during the paving drive of the road finishing machine 3. The paving material is supplied by the truck 1 and dumped into the material hopper 9 of the driving road finishing machine 3. While the paving material is being dumped from the truck 1 into the material hopper 9 of the road finishing machine 3, the truck 1 is driving in front of the road finishing machine 3.

In the illustrated embodiment, a distance sensor 15 is provided at the road finishing machine 3 and measures a distance between the road finishing machine 3 and the truck 1 driving in front of the road finishing machine 3. The distance sensor 15 may in particular measure a distance between an attachment point of the distance sensor 15 at the road finishing machine 3 and a rear tire of the truck 1.

However, it would also be conceivable that the distance sensor 15 measures the distance between an attachment point of the distance sensor 15 at the road finishing machine 3 and another position at the truck 1. For example, a reflector surface for measuring signals emitted by the distance sensor 15 could be provided in a rear region of the truck 1. The distance sensor 15 could be embodied, for example, as an ultrasonic sensor or as a radar sensor.

Based on the distance measurement by the distance sensor 15, a distance between the driving road finishing machine 3 and the truck 1 driving in front of the road finishing machine 3 is kept constant. The distance between the road finishing machine 3 and the truck 1 may be controlled to a predetermined setpoint or to a predetermined set range. Distance control may be effected by adapting the speed of the truck 1.

The distance between the road finishing machine 3 and the truck 1 is controlled to a value or range which permits a material transfer between the truck 1 and the road finishing machine 3 by dumping the paving material from a loading cavity 17 of the truck 1 into the material hopper 9 of the road finishing machine 3. The distance control ensures that during the tilting of the loading cavity 17, at least the major part of the material actually reaches the material hopper 9 of the road finishing machine 3.

Figure 2:
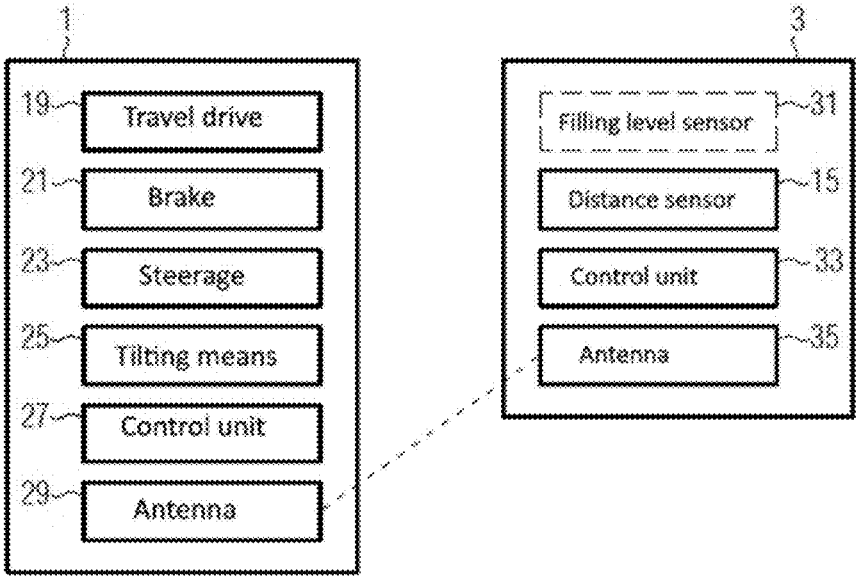
FIG. 2 shows a schematic block diagram which shows components of the truck and the road construction vehicle from FIG. 1.

As is represented in FIG. 2, the truck 1 comprises a travel drive 19, a brake 21, a steerage 23, a lilting device 25, a control unit 27 and an antenna 29. The travel drive 19 may comprise, for example, a main power plant, in particular a diesel engine. The lilting device 25 is embodied for lifting or lowering the loading cavity 17. By actuating the tilting device 25 for lifting the loading cavity 17, the loading cavity 17 may be inclined and dump material from the loading cavity 17 to the rear. The control unit 27 of the truck 1 may control various functions of the truck 1. In particular, the control unit 27 may control the travel drive 19, the brake 21 and the tilting device 25. The antenna 29 is embodied for the wireless communication with the road finishing machine 3.

The road finishing machine 3 comprises a filling level sensor 31, the distance sensor 15, a control unit 33 and an antenna 35. The filling level sensor 31 is configured to determine a filling level of the material hopper 9. For example, the filling level sensor 31 may determine a distance of paving material in the material hopper 9 to an attachment point of the filling level sensor 31. The filling level sensor 31 may for example comprise a radar sensor or an ultrasonic sensor. The control unit 33 of the road finishing machine 3 may control various functions of the road finishing machine 3. The antenna 35 is configured for the wireless communication with the truck 1.

If the road finishing machine 3 is to be supplied with paving material by the truck 1, a driver of the truck 1 will move the truck 1 initially in front of the road finishing machine 3 into the driving path of the road finishing machine 3. Via the antenna 29 of the truck 1 and the antenna 35 of the road finishing machine 3, wireless communication between the truck 1 and the road finishing machine 3 is established. The wireless connection may be established directly between the truck 1 and the road finishing machine 3. However, it would also be conceivable that the wireless connection is established indirectly via one or several intermediate stations, for example a server. The wireless connection could be established, for example, by WIFI, Bluetooth. ZigBee or the Internet. An identification of the road finishing machine 3 and/or the truck 1 may be effected upon the establishment of the wireless connection. If the road finishing machine 3 has approached the truck 1 sufficiently from behind, the control of the travel drive 19 and the brake 21 of the truck 1 is adopted by the distance control based on the distance between the road finishing machine 3 and the truck 1 measured by the distance sensor 15. The truck's driver may enable the control of the travel drive 19 and the brake 21 of the truck for the distance control. According to a variant, the control unit 33 of the road finishing machine 3 generates control instructions for the travel drive 19 and the brake 21 of the truck 1 based on the output of the distance sensor 15. These control instructions may be transmitted via the wireless connection to the truck 1. It would also be conceivable that only measuring signals are transmitted from the distance sensor 15 to the truck 1 via the wireless connection, and the control unit 27 of the truck 1 generates the control instructions for the travel drive 19 and the brake 21 of the truck 1. The steerage of the truck 1 preferably remains the truck driver's job even during the distance control. During distance control, the truck 1 is driving in front of the road finishing machine 3 without any physical contact with the road finishing machine 3.

During distance control, the truck 1 is dumping paving material into the material hopper 9 of the road finishing machine 3 by inclining the loading cavity 17. The lilting device 25 of the truck 1 may be remote-controlled. In particular, the tilting device 25 may be remote-controlled from the road finishing machine 3. According to a simple embodiment, the tilting device 25 of the truck 1 is remote-controlled by manual inputs of a driver of the road finishing machine 3. Corresponding commands could be transmitted via the wireless connection between the truck 1 and the road finishing machine 3. As an alternative, the control of the tilting device 25 may be accomplished automatically based on information received from the filling level sensor 31 of the road finishing machine 3. Depending on the current filling level of the material hopper 9, the loading cavity 17 of the road finishing machine 1 could be lifted or lowered as required to dump more material into the material hopper 9 or to slow down or stop the flow of material into the material hopper 9.

Preferably, for safety reasons, the driver of the truck 1 has at any lime the possibility of intervening in the control of the travel drive 19, the brake 21 and the tilting device 25. Upon termination of the material transfer, the driver of the truck 1 may completely take over the control of the truck 1 again and drive away to the front to give way to the next truck 1.

Figure 3:
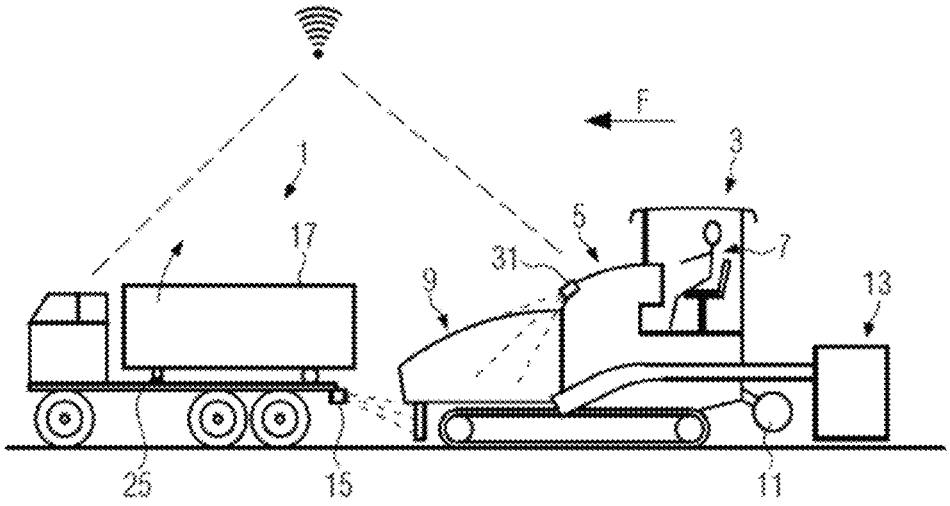
FIG. 3 shows a schematic representation for describing a material transfer between a truck and a road construction vehicle embodied as a road finishing machine according to an embodiment with a distance sensor provided at the truck.
Figure 4:
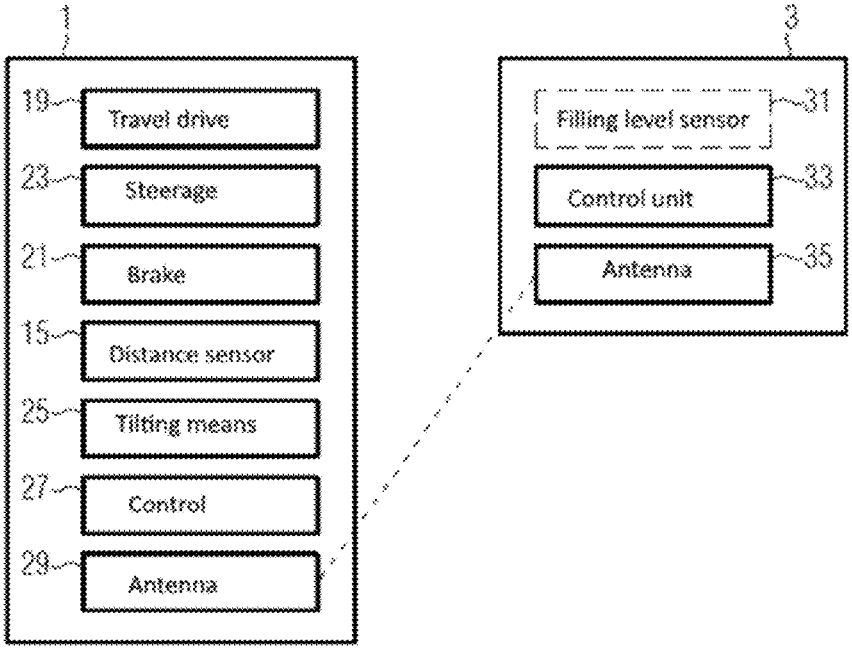
FIG. 4 shows a schematic block diagram which shows components of the truck and the road construction vehicle from FIG. 3.

FIGS. 3 and 4 show an alternative embodiment. The embodiment shown in FIGS. 3 and 4 is very similar to the embodiment shown in FIGS. 1 and 2. Only differences to the embodiment shown in FIGS. 1 and 2 are described.

Basically, the embodiment of FIGS. 3 and 4 differs from the embodiment of FIGS. 1 and 2 in that the distance sensor 15 is not attached to the road finishing machine 3 but to the truck 1. As in the embodiment of FIGS. 1 and 2, the calculation of the control signals for the travel drive 19 and the brake 21 of the truck may be accomplished based on the output of the distance sensor 15 by the control unit 27 of the truck 1. As in the embodiment of FIGS. 1 and 2, however, it is possible here, too, that the control signals for the travel drive 19 and the brake 21 of the truck are generated by the control unit 33 of the road finishing machine 3. To this end, measuring signals generated by the distance sensor 15 could be transmitted via the wireless connection to the road finishing machine 3, and control instructions subsequently generated by the control unit 33 of the road finishing machine 3 could be returned to the truck 1 via the wireless connection.

Figure 5:
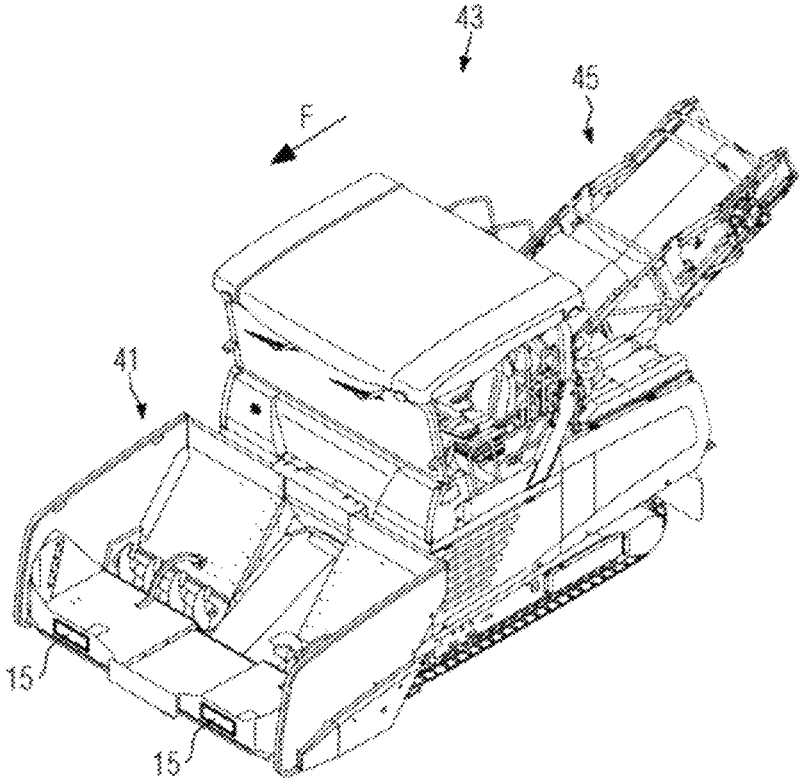
FIG. 5 shows a schematic representation of a feeder for a road finishing machine.

In the above-described embodiments, a material hopper 9 of a mad finishing machine 3 is filled with paving material by the truck 1, respectively. As an alternative, it would be, however, conceivable to supply the material hopper 41 of a feeder 43 for a road finishing machine with paving material with the truck 1. An example of such a feeder 43 is shown in FIG. 5. The feeder 43 is a vehicle which is driving in front of a road finishing machine 3 that is installing a road surface to supply the material hopper 9 of the road finishing machine 3 with paving material. The feeder 43 comprises a material hopper 41 for receiving paving material in front with respect to the paving direction F. The material hopper 41 of the feeder 43 could be supplied with paving material by the truck 1 during the drive of the feeder 43 in the manner described above for the filling of a material hopper 9 of a road finishing machine 3. To this end, a distance sensor 15 may be provided at the feeder 43 (analogous to the embodiment of FIGS. 1 and 2). As an alternative (analogous to the embodiment of FIGS. 3 and 4), the distance sensor 15 could be provided at the truck 1. With respect to the paving direction F in the rear region, the feeder 43 comprises a conveying device 45 for supplying paving material to the material hopper 9 of a mad finishing machine 3 driving behind the feeder 43. The paving material is brought from the material hopper 41 of the feeder 43 to the conveying device 45 via non-depicted transport device.

The device and operations described with respect to FIGS. 1 to 4 for supplying a material hopper 9 of a road finishing machine 3 may be analogously transferred to a material transfer between a truck 1 and a feeder 43 by dumping paving material from the loading cavity 17 of the truck 1 into the material hopper 41 of the feeder 43. In particular, the distance control between the truck 1 and the road finishing machine 3 described with reference to FIGS. 1 to 4 may be analogously transferred to a corresponding distance control between a truck 1 and a feeder 43 driving behind it.

What is claimed is:

1. A method for transferring material between a truck and a driving road construction vehicle wherein the road construction vehicle is a road finishing machine or a feeder for a road finishing machine, the method comprising:

keeping constant, by a distance control system, a distance between the driving road construction vehicle and a truck driving in front of the road construction vehicle without contact with the road construction vehicle; and dumping material from a loading cavity of the truck into a material hopper of the road construction vehicle while the distance between the driving road construction vehicle and the truck is kept constant;

wherein the distance control system comprises a distance sensor which determines the distance between the driving road construction vehicle and the truck driving in front of the road construction vehicle;

wherein the distance sensor is provided on one of the road construction vehicle and the truck; and wherein the distance control system controls the distance between the driving road construction vehicle and the truck driving in front of the road construction vehicle to a value which is selected from a lookup table based on a type of the truck and/or a type of the road construction vehicle.

2. The method according to claim 1, wherein the truck is driven by its own travel drive during the material transfer.

3. The method according to claim 1, wherein the distance control system generates control instructions for a speed of the truck.

4. The method according to claim 1, wherein the distance control system comprises a control unit which automatically controls a travel drive and/or a brake of the truck to keep the distance between the driving road construction vehicle and the truck constant.

5. The method according to claim 1, wherein information for the distance control are wirelessly transmitted from the road construction vehicle to the truck.

6. The method according to claim 1, wherein steering of the truck is performed by a driver of the truck.

7. The method according to claim 3, wherein the sensor comprises an ultrasonic sensor or a radar sensor.

8. The method according to claim 1, wherein the distance sensor is provided on only one of the road construction vehicle and the truck.

9. The method according to claim 1, wherein the lookup table is based on geometries of different types of trucks and different types of road construction vehicles.

10. The method according to claim 9, wherein the geometries are specific geometries.

11. The method according to claim 1, wherein a tilting function of the loading cavity of the truck is remote-controlled from the road construction vehicle.

12. The method according to claim 11, wherein the tilting function of the loading cavity of the truck is manually remote-controlled by a driver of the road construction vehicle.

13. The method according to claim 11, wherein a filling level sensor is provided at the road construction vehicle which determines a filling level of the material hopper, and where-in the tilting function of the loading cavity of the truck is automatically remote-controlled based on an output of the filling level sensor.

14. The method according to claim 1, wherein the keeping constant, by a distance control system, the distance and the dumping both occur while the driving road construction vehicle and the truck are moving.

15. A distance control system for keeping constant a distance between a driving road construction vehicle and a truck driving in front of the road construction vehicle without contact with the road construction vehicle during a material transfer between the truck and the road construction vehicle, wherein the road construction vehicle is a road finishing machine or a feeder for a road finishing machine, the system comprising: a distance sensor which determines the distance between the driving road construction vehicle and the truck driving in front of the road construction vehicle, wherein the distance sensor is provided on one of the road construction vehicle and the truck, wherein the distance control system controls the distance between the driving road construction vehicle and the truck driving in front of the road construction vehicle to a value which is selected from a lookup table based on a type of the truck and/or a type of the road construction vehicle.

16. The system according to claim 15, further comprising a control unit which automatically controls a travel drive and/or a brake of the truck to keep the distance between the driving road construction vehicle and the truck constant.

17. The system according to claim 15, wherein the sensor comprises an ultrasonic sensor or a radar sensor.

18. The system according to claim 15, wherein the distance sensor is provided on only one of the road construction vehicle and the truck.

19. The method according to claim 15, wherein the lookup table is based on specific geometries of different types of trucks and different types of road construction vehicles.

* * * * *